US009932195B2

(12) United States Patent
Sekigawa

(10) Patent No.: US 9,932,195 B2
(45) Date of Patent: Apr. 3, 2018

(54) SHEET CONVEYING APPARATUS, SHEET PROCESSING APPARATUS AND IMAGE FORMING APPARATUS

(71) Applicant: CANON KABUSHIKI KAISHA, Tokyo (JP)

(72) Inventor: Akito Sekigawa, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/484,535

(22) Filed: Apr. 11, 2017

(65) Prior Publication Data

US 2017/0217713 A1 Aug. 3, 2017

Related U.S. Application Data

(63) Continuation of application No. 14/520,594, filed on Oct. 22, 2014, now Pat. No. 9,665,055.

(30) Foreign Application Priority Data

Nov. 1, 2013 (JP) ..... 2013-228591

(51) Int. Cl.
*G03G 15/00* (2006.01)
*B65H 31/30* (2006.01)

(52) U.S. Cl.
CPC ..... *B65H 31/3081* (2013.01); *G03G 15/6529* (2013.01); *B65H 2301/42266* (2013.01); *B65H 2404/231* (2013.01); *B65H 2801/06* (2013.01)

(58) Field of Classification Search
CPC ..... B65H 31/3081; B65H 2301/42266; B65H 2404/231; B65H 2861/06; G03G 15/6529
See application file for complete search history.

(56) References Cited

U.S. PATENT DOCUMENTS

| | | | |
|---|---|---|---|
| 2,276,978 | A | 3/1942 | Hyman et al. |
| 8,087,667 | B2 | 1/2012 | Sekigawa |
| 8,240,664 | B2 | 8/2012 | Sekigawa |
| 8,500,122 | B2 | 8/2013 | Kushida et al. |
| 8,550,461 | B2 | 10/2013 | Sekigawa et al. |
| 8,776,993 | B2 | 7/2014 | Umeda |
| 2006/0066831 | A1 | 3/2006 | Terao et al. |
| 2013/0285312 | A1 | 10/2013 | Tokuma et al. |
| 2014/0030000 | A1 | 1/2014 | Gamo et al. |

FOREIGN PATENT DOCUMENTS

| | | | |
|---|---|---|---|
| JP | 2000-219399 | A | 8/2000 |
| JP | 2001-341157 | A | 12/2001 |

*Primary Examiner* — Matthew G Marini
(74) *Attorney, Agent, or Firm* — Fitzpatrick, Cella, Harper & Scinto

(57) ABSTRACT

A sheet conveying apparatus has a belt with a widthwise side portion extending in a traveling direction of the belt, the widthwise side portion including a portion defining a notch being recessed in a width direction orthogonal to the traveling direction, the notch being defined by less than an entire length, in the traveling direction, of the widthwise side portion, a contacting member arranged to be in contact with an end portion of a sheet to be conveyed, the contacting member being attached to the belt so that at least a part of the contacting member is arranged in the notch of the belt, a regulating portion configured to regulate a position of the belt in the width direction by contacting with the widthwise side portion of the belt, and a driving portion configured to drive the belt.

19 Claims, 18 Drawing Sheets

SHEET CONVEYING APPARATUS, SHEET PROCESSING APPARATUS AND IMAGE FORMING APPARATUS

This application is a Continuation Application of U.S. patent application Ser. No. 14/520,594, which was filed on Oct. 22, 2014, and allowed on Jan. 18, 2017, which itself claims the benefit of Japanese Patent Application No. 2013-228591, filed on Nov. 1, 2013, which are hereby incorporated by reference herein in their entireties.

BACKGROUND OF THE INVENTION

Field of the Invention

The present invention relates to a sheet conveying apparatus configured to convey a sheet and a sheet processing apparatus and an image forming apparatus including the same.

Description of the Related Art

Hitherto, there has been known a sheet processing apparatus configured to align a plurality of sheets on which images have been formed and to perform a post-processing operation such as a binding process on the plurality of sheets. For instance, a sheet processing apparatus disclosed in Japanese Patent Application Laid-open No. 2000-219399 is configured to stack and align sheets on which images have been formed on a processing tray, to perform a post-processing operation on the sheets to form a sheet bundle, and to push a rear edge of the sheet bundle by a bundle discharge member to discharge to a stacking tray.

Here, the bundle discharge member is attached to a discharge belt and is configured to move along with a travel of the discharge belt. Therefore, the bundle discharge member needs to be movably provided in a body with the discharge belt. Then, Japanese Patent Application Laid-open No. 2001-341157 has proposed a technology of providing the discharge belt with a support projection, of setting the discharge belt on a molding die, and of injection-molding the bundle discharge member on the support projection.

However, the bundle discharge member is often formed into an asymmetrical shape in a sheet conveying direction centering on the support projection such the bundle discharge member can readily push out the sheet bundle. Due to that, it is necessary to form a shape of the molding die into the asymmetrical shape centering on the support projection. Then, if the molding die is formed into the asymmetrical shape, there is a possibility that a flow rate balance of resin becomes inhomogeneous before and after the support projection when the resin is injected into the molding die. Because the support projection is held in a free condition within the molding die, the support projection is deformed so as to incline in an either direction before and after the support projection if the flow rate balance of the resin collapses before and after the support projection. Thereby, if the discharge belt is taken out of the molding die after completing the injection molding, the bundle discharge member is inclined either into a front or rear part of the bundle discharge member and a posture of the bundle discharge member is destabilized. As a result, a posture of a sheet bundle discharged by the bundle discharge member is destabilized, possibly causing conveying failure.

SUMMARY OF THE INVENTION

According to an aspect of the invention, a sheet conveying apparatus has a belt with a widthwise side portion extending in a traveling direction of the belt, the widthwise side portion including a portion defining a notch being recessed in a width direction orthogonal to the traveling direction, the notch being defined by less than an entire length, in the traveling direction, of the widthwise side portion, a contacting member arranged to be in contact with an end portion of a sheet to be conveyed, the contacting member being attached to the belt so that at least a part of the contacting member is arranged in the notch of the belt, a regulating portion configured to regulate a position of the belt in the width direction by contacting with the widthwise side portion of the belt, and a driving portion configured to drive the belt.

Additional features of the present invention will become apparent from the following description of exemplary embodiments with reference to the attached drawings.

DESCRIPTION OF THE EMBODIMENTS

An image forming apparatus including a sheet processing apparatus having a sheet conveying apparatus of an embodiment of the present invention will be explained with reference to the drawings. The image forming apparatus of the embodiment of the invention includes a finisher, i.e., a sheet processing apparatus, capable of performing a process of binding a plurality of sheets (sheet bundle), such as a copier, a printer, a facsimile, and a multi-function printer. The following embodiments will be explained by exemplifying an electro-photographic laser beam printer (referred to simply as a 'printer' hereinafter) 900.

First Embodiment

Figure 1:
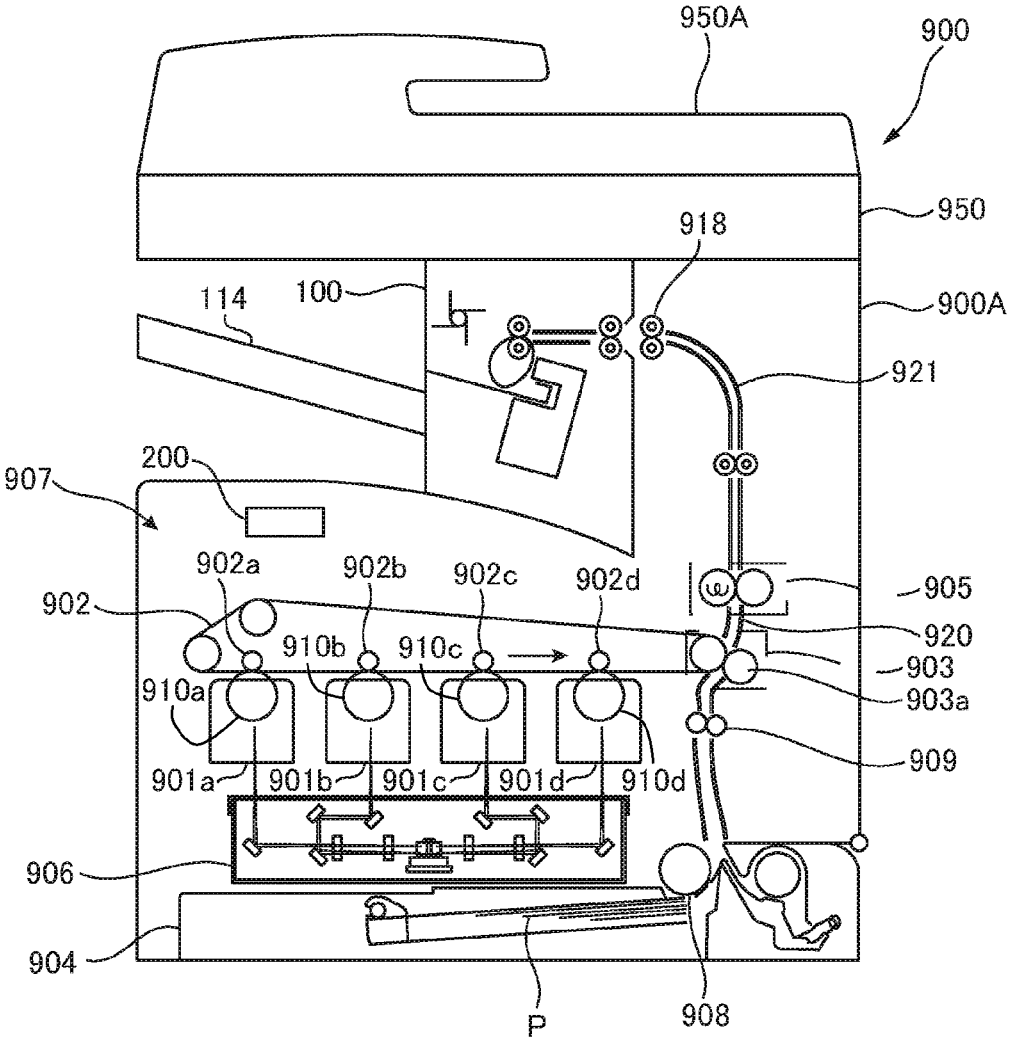
FIG. 1 is a section view schematically showing a printer of a first embodiment of the invention.

The printer 900 of the first embodiment will be explained with reference to FIGS. 1 through 13. At first, a schematic structure of the printer 900 will be explained with reference to FIG. 1. FIG. 1 is a section view showing the structure of the printer 900 of the first embodiment of the invention.

As shown in FIG. 1, the printer 900 includes an image forming apparatus body (referred to as a 'printer body' hereinafter) 900A configured to form an image on a sheet P, an image reading apparatus 950 configured to be able to read an image of a document, and a finisher 100, i.e., a sheet processing apparatus. In the present embodiment, the image reading apparatus 950 includes a document feeder 950A configured to be able to automatically feed a document, and the finisher 100 is disposed between an upper surface of the printer body 900A and the image reading apparatus 950.

The printer body 900A includes photosensitive drums 910*a* through 910*d* forming toner images of respective colors of yellow, magenta, cyan and black, and an intermediate transfer belt 902 carrying toner images formed on the photosensitive drums 910*a* through 910*d*. The photosensitive drums 910*a* through 910*d* are configured to be driven rotatably by a motor not shown, and a primary charger, a developer and a transfer charger not shown are disposed respectively around each of the photosensitive drums 910*a* through 910*d*. The respective photosensitive drums 910*a* through 910*d* and the primary charger, the developer and the transfer charger are unitized as process cartridges 901*a* through 901*d*, respectively. The process cartridges 901*a* through 901*d* are configured to be removable from the printer body 900A. An exposure unit 906 composed of a polygon mirror and others is also disposed below the photosensitive drums 910*a* through 910*d*.

For instance, when the image reading apparatus 950 reads the image of the document, a laser beam of yellow component color is projected at first to the photosensitive drum 910*a* through the polygon mirror and others of the exposure unit 906 and an electrostatic latent image is formed on the photosensitive drum 910*a*. Then, yellow toner is supplied from the developer to the photosensitive drum 910*a*, so that the electrostatic latent image is visualized as a yellow toner image. When the toner image arrives at a primary transfer portion where the photosensitive drum 910*a* comes into contact with the intermediate transfer belt 902 as the photosensitive drum 910*a* rotates, the yellow toner image on the photosensitive drum 910*a* is transferred to the intermediate transfer belt 902 by a primary transfer bias applied to a transfer charge member 902*a*.

When a region carrying the yellow toner image of the intermediate transfer belt 902 moves in a direction of an arrow in FIG. 1, a magenta toner image, formed on the photosensitive drum 910*b* until then in the similar manner as described above, is superimposed and transferred upon the yellow toner image on the intermediate transfer belt 902. In the same manner, as the intermediate transfer belt 902 moves, a cyan toner image formed on the photosensitive drum 910*c* and a black toner image formed on the photosensitive drum 910*d* are superimposed and transferred to the intermediate transfer belt 902, and the four color toner images are thus transferred on the intermediate transfer belt 902.

Meanwhile, the sheet P on which the image is to be formed is stored in a cassette 904 provided at a lower part of the printer body 900A and is sent out one by one from the cassette 904 by a pickup roller 908. After when a registration roller 909 adjusts timing of the sheet P sent out of the cassette 904, the sheet P reaches a secondary transfer portion 903 and the four color toner images on the intermediate transfer belt 902 are collectively transferred onto the sheet P by a secondary transfer bias applied to a secondary transfer roller 903*a*.

The sheet P on which the four color toner images have been transferred is then conveyed to a fixing roller pair 905 by being guided by a conveyance guide 920. The toners of the respective colors are melted and blended by receiving heat and pressure from the fixing roller pair 905 and are fixed as a full color print image. The sheet P on which the image has been fixed in an image forming portion 907 is conveyed to a finisher 100 by a discharge roller pair 918 through a conveyance guide 921.

The finisher 100 sequentially takes in the sheet P discharged out of the printer body 900A, aligns and bundles a plurality of such sheets P thus taken in as one bundle, and performs a binding process (post processing) of binding an upstream end portion (referred to as a 'read end portion' hereinafter) in a conveying direction of the bundled sheet bundle. It is noted that the finisher 100 will be explained in detail later.

The sheet bundle on which the post processing has been performed by the finisher 100 is discharged out of the finisher 100 and is stacked on a stacking tray 114. In a case where it is not necessary to perform the post processing by the finisher 100, the sheet P conveyed to the finisher 100 passes through the finisher 100 without undergoing the post processing and is discharged out of the finisher 100 to be stacked on the stacking tray 114.

Figure 2:
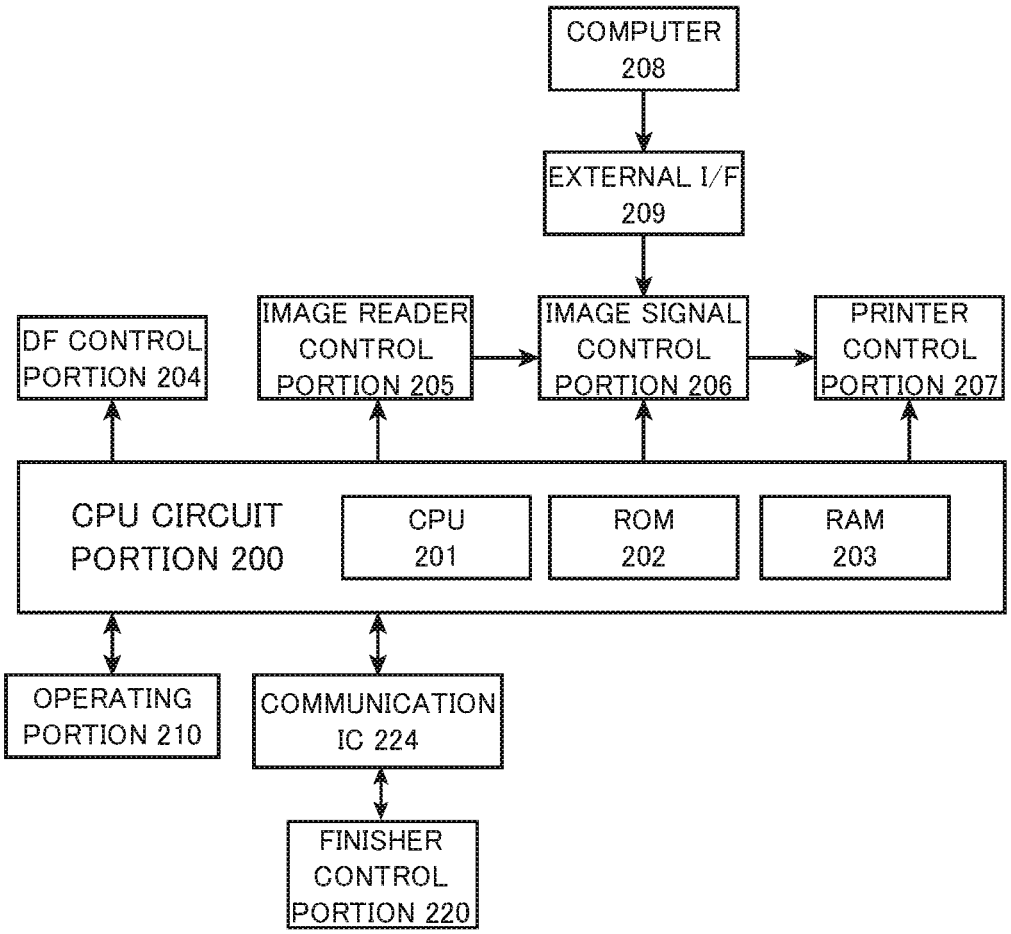
FIG. 2 is a control block diagram of a controller of the printer of the first embodiment.
Figure 3:
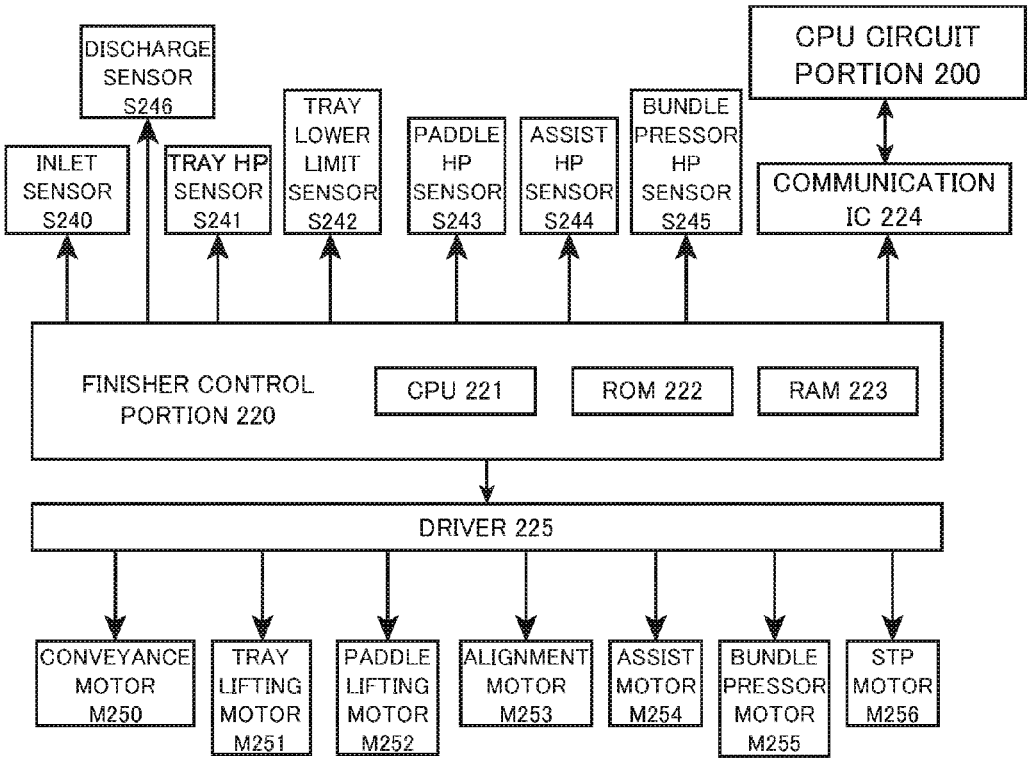
FIG. 3 is a control block diagram of a finisher control portion of the first embodiment.

Next, a configuration of the controller 260 controlling the printer 900 will be explained with reference to FIGS. 2 and 3. FIG. 2 is a control block diagram of the controller 260 of the printer 900 of the present embodiment and FIG. 3 is a control block diagram of a finisher control portion 220 of the present embodiment.

As shown in FIG. 2, the controller 260 includes a CPU circuit portion 200, and the CPU circuit portion 200 includes a CPU 201, a ROM 202 and a RAM 203. Control programs and others are stored in the ROM 202, and the RAM 203 is used as an area for tentatively holding control data and as a work area of calculations for control.

Based on the control program stored in the ROM 202, the CPU circuit portion 200 collectively controls a document feeder (DF) control portion 204, an image reader control portion 205, an image signal control portion 206, a printer control portion 207 and a finisher control portion 220. Based on an instruction from the CPU circuit portion 200, the DF control portion 204 drives and controls the document feeder 950A. The image reader control portion 205 drives and controls a scanner unit, an image unit and others of the image reading apparatus 950 and transfers an analog image signal outputted from the image sensor to the image signal control portion 206 based on an instruction from the CPU circuit portion 200.

The image signal control portion 206 converts the analog image signal outputted from the image sensor into a digital signal and converts a digital signal to a video signal to output to the printer control portion 207. In a case where the digital image signal is inputted from a computer 208 connected externally to the printer body 900A through an external I/F 209, the image signal control portion 206 converts the inputted digital image signal to a video signal to output to the printer control portion 207. It is noted that this processing operation performed by the image signal control portion 206 is controlled by the CPU circuit portion 200. The printer control portion 207 drives and controls the printer body 900A (the exposure unit 906 and others described above) based on the video signal thus inputted.

An operation portion 210 includes a plurality of keys for setting various functions related to an image forming operation and a display portion indicating set conditions, and outputs a key signal corresponding to an operation of each key to the CPU circuit portion 200 and displays information corresponding to a signal from the CPU circuit portion 200 on the display portion. The finisher control portion 220 drives and controls the entire finisher 100 by exchanging information with the CPU circuit portion 200 mounted in the finisher 100 through a communication IC 224.

As shown in FIG. 3, the finisher control portion 220 includes the CPU 221, a ROM 222 in which a control program and others are stored, and a RAM 223 used as an area for tentatively holding control data and as a work area of calculations for control. The finisher control portion 220 exchanges data with the CPU circuit portion 200 through the communication IC 224 and drives and controls the finisher 100 by executing various programs stored in the ROM 222 based on an instruction from the CPU circuit portion 200.

For instance, the finisher control portion 220 drives and controls various motors of the finisher 100 through the driver 225 based on signals inputted from various sensors of the finisher 100. The various sensors are an inlet sensor S240, a tray HP sensor S241, a tray lower limit sensor S242, a paddle HP sensor S243, an assist HP sensor S244, a bundle pressor HP sensor S245, a discharge sensor S246, and others. The various motors are a conveying motor M250, a tray lifting motor M251, a paddle lifting motor M252, an alignment motor M253, an assist motor M254, a bundle pressor motor M255, a STP motor M256 and others.

Next, the finisher 100 described above will be explained with reference to FIGS. 4A through 13. At first, a schematic configuration of the finisher 100 will be explained with reference to FIGS. 4A through 5C along a move of the sheet P. FIGS. 4A through 5C are section views explaining the finisher 100 of the present embodiment.

Figure 4A:
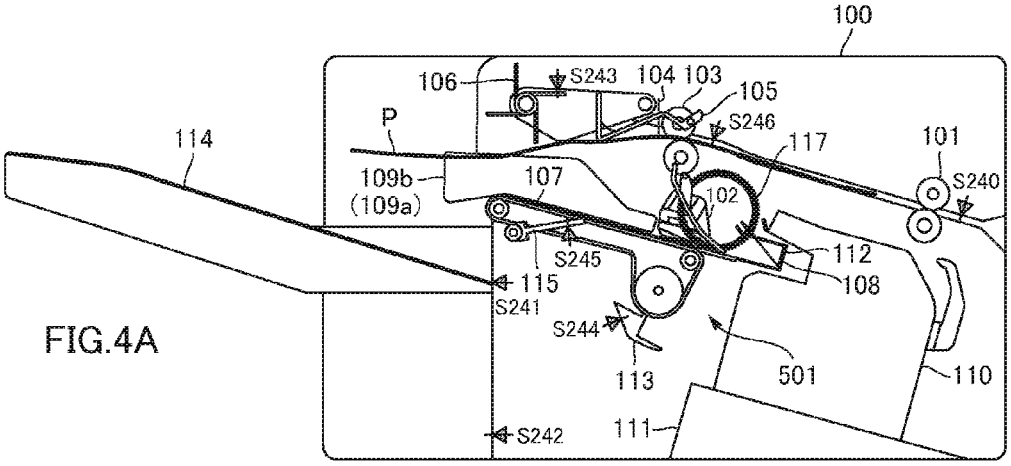
FIG. 4A is a section view illustrating a finisher of the first embodiment and showing a state in which a sheet is conveyed from a printer body to a conveying path.

As shown in FIG. 4A, a sheet P discharged out of the printer body 900A is passed to an inlet roller 101 driven by the conveying motor M250 and the inlet roller 101 conveys the sheet P to a conveying path. At this time, the inlet sensor S240 detects that the sheet P has been passed to the inlet roller 101. The sheet P moving through the conveying path is then passed to a discharge roller 103 and is conveyed to a processing tray 107 while being destaticized by a destatisizing needle 104 while being conveyed by the discharge roller 103 in a condition in which a rear end dropping member 105 is lifted by a front end portion of the sheet P.

At this time, the discharge sensor S246 provided upstream in the conveying direction of the discharge roller 103 detects that the sheet P has been discharged to the processing tray 107, and based on this detection signal, the finisher control portion 220 controls a stapler 110 and others described later. It is noted that a time required to drop to the processing tray 107 of the sheet P discharged to the processing tray 107 by the discharge roller 103 is shortened by pushing the sheet P from an upper side thereof by the rear end dropping member 105.

Figure 4B:
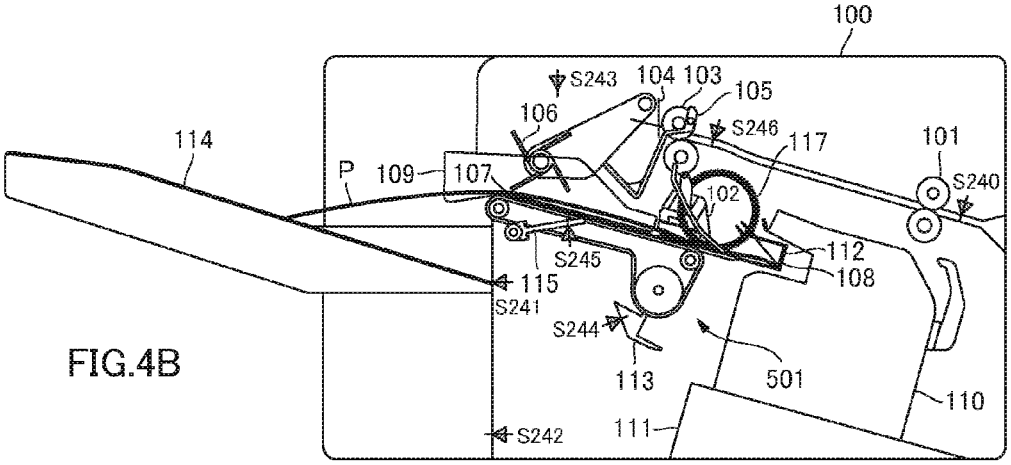
FIG. 4B is a section view illustrating the finisher of the first embodiment and showing a state in which the sheet falls down to a processing tray.

As shown in FIG. 4B, when the sheet P drops to the processing tray 107, a paddle 106 is lowered by the paddle lifting motor M252 to the processing tray 107 side centering on a rotation shaft. At this time, the paddle 106 is rotated by the conveying motor M250 counterclockwise in FIG. 4B, and the sheet P in contact with the paddle 106 is conveyed toward a rear end stopper 108 located relatively at a right-hand side in FIG. 4B. When a rear end portion of the sheet P is passed to a knurling belt 117, the paddle lifting motor M252 drives the paddle 106 in an up-lift direction and when the paddle HP sensor S243 detects HP (home position) of the paddle 106, the drive of the paddle lifting motor M252 is stopped.

After conveying the sheet P conveyed by the paddle 106 to the rear end stopper 108 restricting the rear end portion of the sheet P, the knurling belt 117 biases the sheet P always toward the rear end stopper 108 side by conveying the sheet P while slipping with the sheet P. Due to this slip conveyance, the rear end portion of the sheet P abuts against the rear end stopper 108 and skew of the sheet P is corrected. The sheet P abutting against the rear end stopper 108 is aligned in a direction orthogonal to a sheet conveying direction and a sheet thickness direction (referred to as a 'width direction' hereinafter) by a pair of aligning plates 109 moved by the alignment motor M253. A sheet bundle PA aligned on the processing tray 107 is formed by repeating this series of operations (see also FIG. 5A).

Figure 5A:
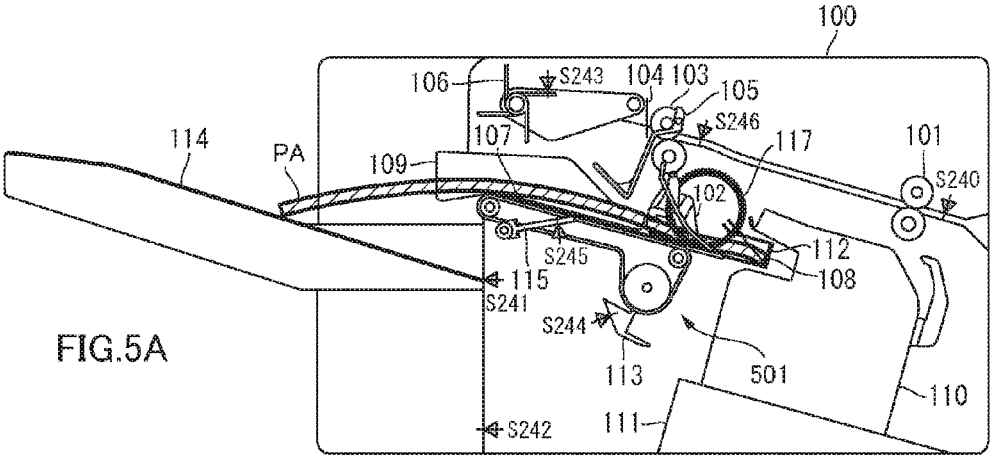
FIG. 5A is a section view illustrating the finisher of the first embodiment and showing a state in which a sheet bundle is formed.
Figure 5B:
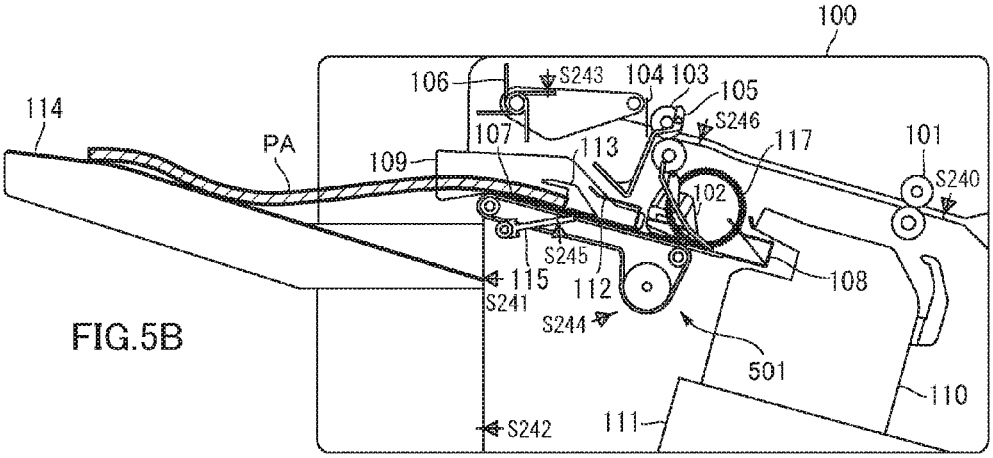
FIG. 5B is a section view illustrating the finisher of the first embodiment and showing a state in which the sheet bundle is discharged to a stacking tray.

After forming the sheet bundle PA composed of a predetermined number of sheets P, the STP motor M256 driving the stapler (post-processing portion) 110 is driven and the sheet bundle PA is bound in a case of executing a binding process on the sheet bundle PA by a staple. Meanwhile, in a case where no binding process is executed on the sheet bundle P, an aligned sheet bundle PA is discharged to the stacking tray 114 by a sheet conveying apparatus 501. As shown in FIG. 5B, the rear end portion of the sheet bundle PA is pushed by a rear end assist (restricting plate) 112 and a discharge claw (claw member, claw unit) 113 of the sheet conveying apparatus 501, which are both driven by the assist motor M254, to discharge the sheet bundle PA to the stacking tray 114. It is noted that the sheet conveying apparatus 501 will be described later in detail.

Figure 5C:
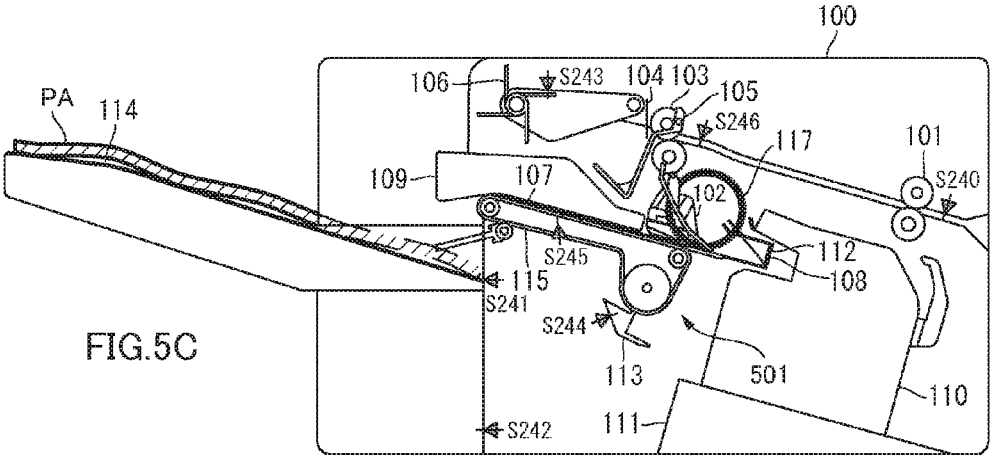
FIG. 5C is a section view illustrating the finisher of the first embodiment and showing a state in which the sheet bundle has been discharged to the stacking tray.

As shown in FIG. 5C, the rear end portion of the sheet bundle PA discharged to the stacking tray 114 is pressed by a bundle pressor 115 that is rotated counterclockwise in FIG. 5C by the bundle pressor motor M255 to prevent the sheet bundle PA from being pushed out in the conveying direction by a sheet bundle discharged in succession. Then, in a case where the sheet bundle PA shades the tray HP sensor S241 after completing to press the rear end portion of the sheet bundle P a stacking tray 114 is lowered by the tray lifting motor M251 until when the tray HP sensor S241 is unshaded to determine a sheet surface level.

It is possible to discharge a required number of sheet bundles PA on the stacking tray 114 by executing the series of operations described above. In a case where the stacking tray 114 is lowered during the operation and shades a tray lower limit sensor S242 (i.e., in a case where the stacking tray 114 is fully loaded), a full-load signal is informed from the finisher control portion 220 to the CPU circuit portion 200 and the image forming operation is stopped. If the sheet bundle PA on the stacking tray 114 is removed after that, the stacking tray 114 elevates until when the tray HP sensor S241 is shaded. Then, the stacking tray 114 is lowered and the tray HP sensor S241 is unshaded. Thereby, the position of the stacking tray 114 is determined again and the image forming operation is started again.

Figure 6:
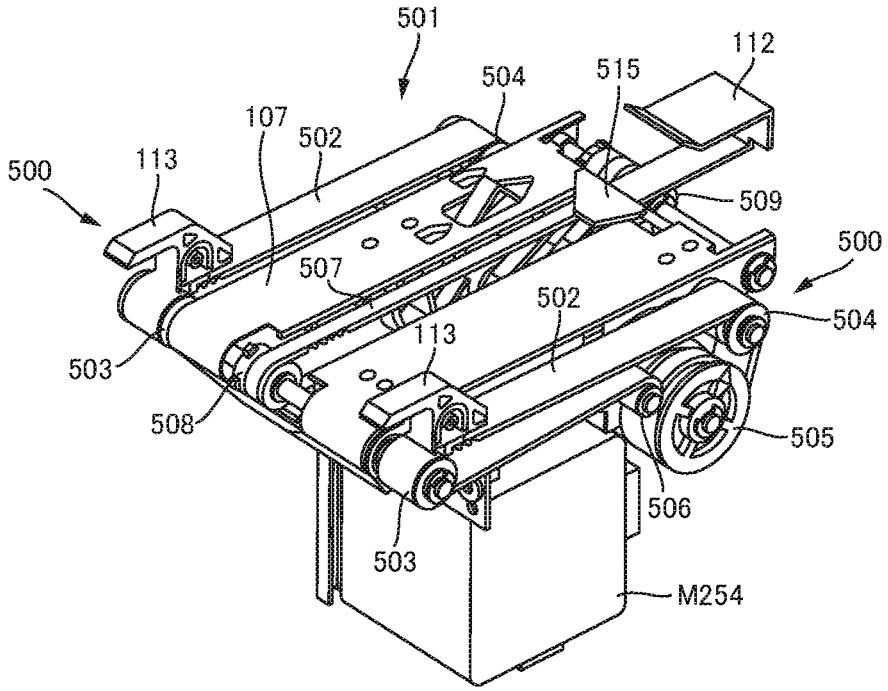
FIG. 6 is a perspective view showing the sheet conveying apparatus of the first embodiment seen obliquely above the sheet conveying apparatus.
Figure 7:
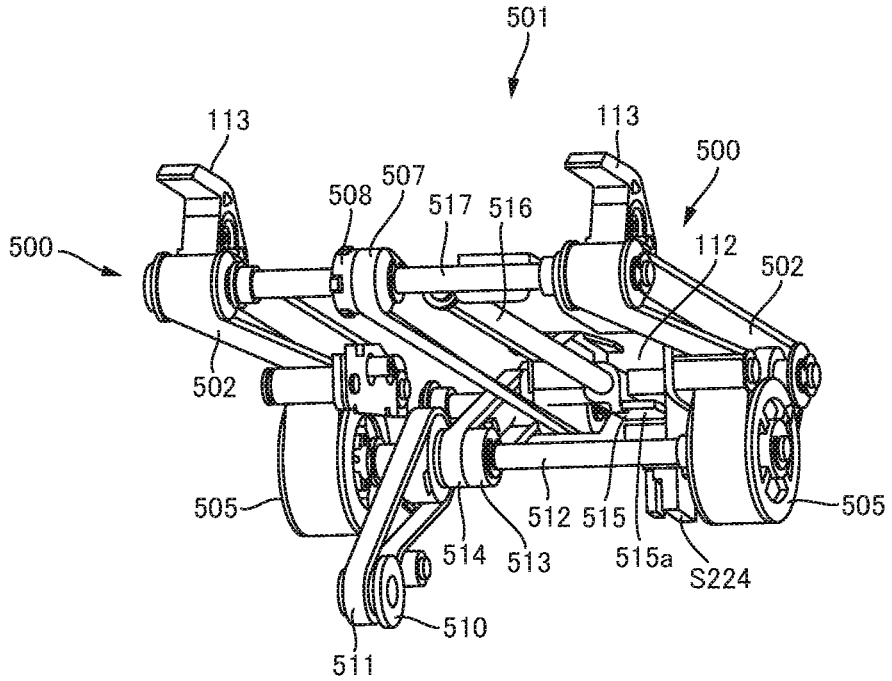
FIG. 7 is a perspective view showing the sheet conveying apparatus of the first embodiment seen obliquely below the sheet conveying apparatus.

Next, the sheet conveying apparatus 501 described above will be explained with reference to FIGS. 6 through 12. At first, a schematic configuration of the sheet conveying apparatus 501 will be explained with reference to FIGS. 6 and 7. FIG. 6 is a perspective view of the sheet conveying apparatus 501 of the first embodiment seen from above the sheet conveying apparatus 501. FIG. 7 is a perspective view of the sheet conveying apparatus 501 of the first embodiment seen from below the sheet conveying apparatus 501. It is noted that the assist motor M254 is omitted in FIG. 7.

As shown in FIGS. 6 and 7, the sheet conveying apparatus 501 includes the discharge claw 113 and the rear end assist 112 capable of pushing the sheet bundle PA on the processing tray 107 and the assist motor (driving motor) M254 driving the discharge claw 113 and the rear end assist 112. The discharge claw 113 is fixed to a discharge belt (belt) 502 and pushes the rear end portion of the sheet bundle PA and conveys the sheet bundle PA as the discharge belt 502 travels. It is noted a belt unit 500 is composed of the discharge belt 502 and the discharge claw 113. Two discharge belts 502 are disposed so as to run in parallel by keeping a distance in the width direction orthogonal to the sheet conveying direction (traveling direction) and the direction of the thickness of the sheet P. That is, the two (a pair of) discharge claws 113 are disposed so as to run in parallel by keeping the distance in the width direction orthogonal to the sheet conveying direction. It is noted that two or more discharge claws 113 and discharge belts 502 may be disposed in parallel by keeping a distance in the width direction. It is also noted that a joint structure of the discharge claw 113 and the discharge belt 502 (the structure in which the discharge claw 113 is fixed to the discharge belt 502) will be described later in detail.

The discharge belt 502 is formed of a toothed belt on which a plurality of belt teeth (teeth) is formed on an inner circumferential surface (a back surface) side thereof and is wrapped around toothed pulleys (driven pulleys) 503 and 504 and a cam pulley (driving pulley) 505. Its tension is kept by a tensioner 506. The rear end assist 112 is connected to an assist belt 507 through an intermediary of an assist slider 515, and the assist belt 507 is wrapped around pulleys 508 and 509.

A driving force of the assist motor M254 is transmitted to a driving belt 511 through an assist motor pulley 510 and is then transmitted to a stepped pulley 513 of an assist camshaft 512 located at a center of rotation of the cam pulley 505 through the driving belt 511. The driving force transmitted to the stepped pulley 513 is transmitted, through the driving belt 514, to the pulley 509 around which the assist belt 507 is wrapped. This arrangement makes it possible to drive the discharge belt 502 and the assist belt 507 by the assist motor M254, i.e., a driving portion rotationally driving the discharge belt 502.

The assist slider 515 connected to the rear end assist 112 is supported slidably on a slider shaft 516. The assist slider 515 also includes the sensor flag 515*a* turning OFF the assist HP sensor S244. That is, it is configured to allow a position of the rear end assist 112 to be detected by the sensor flag 515*a* crossing a sensor part of the assist HP sensor S244 and turning OFF the sensor S244.

Next, an internal structure of the cam pulley 505 configured to travel the discharge belt 502 will be explained with reference to FIGS. 8A through 9B. FIGS. 8A through 9B illustrate how the sheet conveying apparatus 501 operates.

Figure 8A:
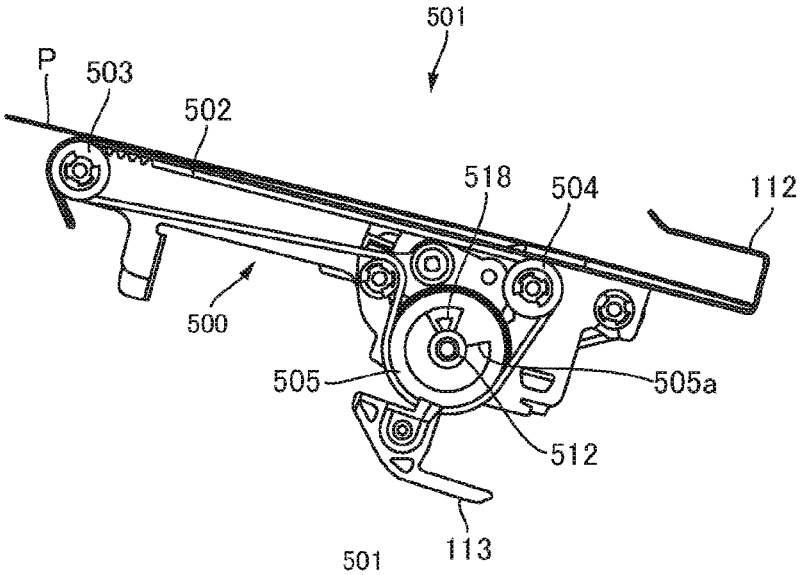
FIG. 8A illustrates an operation of the sheet conveying apparatus of the first embodiment and shows a state before a rear end assist moves.
Figure 8B:
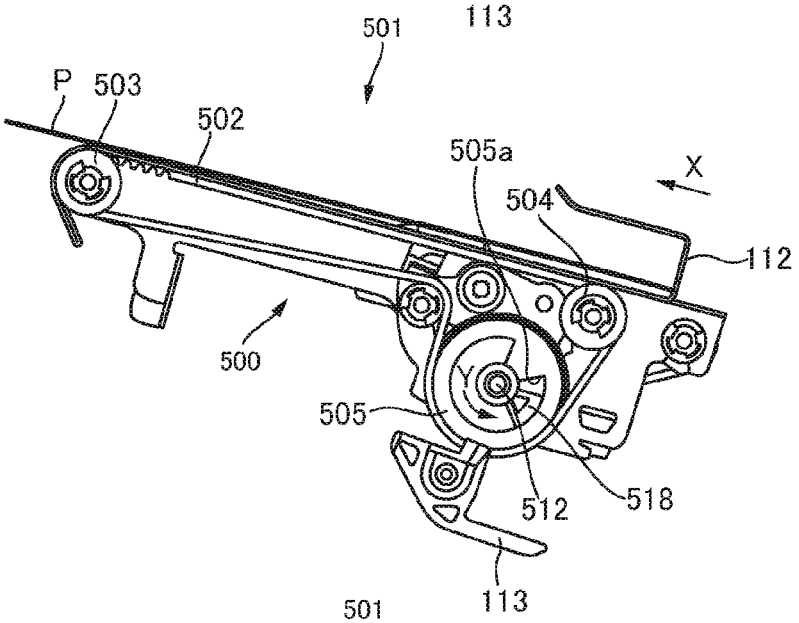
FIG. 8B illustrates an operation of the sheet conveying apparatus of the first embodiment and shows a state in which the rear end assist has started to move.
Figure 8C:
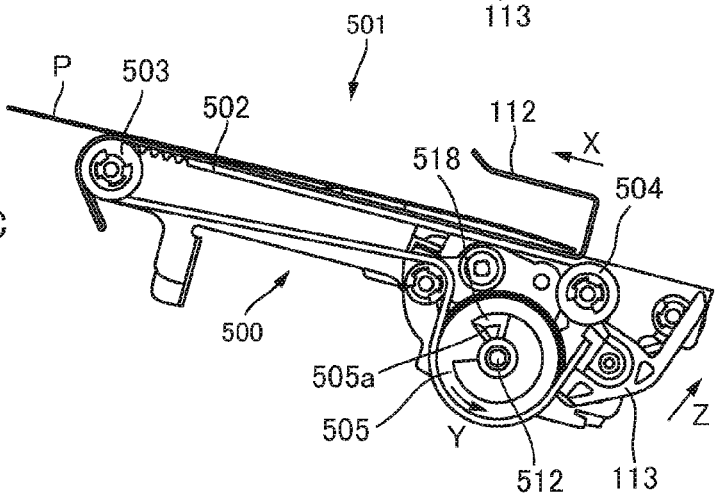
FIG. 8C illustrates an operation of the sheet conveying apparatus of the first embodiment and shows a state in which a discharge claw has started to move.

When the assist motor M254 is driven from a state in which the assist motor M254 is stopped as shown in FIG. 8A to a state as shown in FIG. 8B, the rear end assist 112 moves in a direction of an arrow X and the assist camshaft 512, i.e., the center of rotation of the cam pulley 505, rotates in a direction of an arrow Y. At this time, the cam pulley 505 is configured to rotate idly. As shown in FIG. 8C, it is because a cam 518 is connected to the assist camshaft 512 and the cam pulley 505 is configured to rotate when the cam 518 butts against a rib surface 505*a* formed on the cam pulley 505. When the cam 518 butts against the rib surface 505*a*, the cam pulley 505 also rotates in the direction of the arrow Y and the discharge claw 113 moves in a direction of an arrow Z.

Figure 9A:
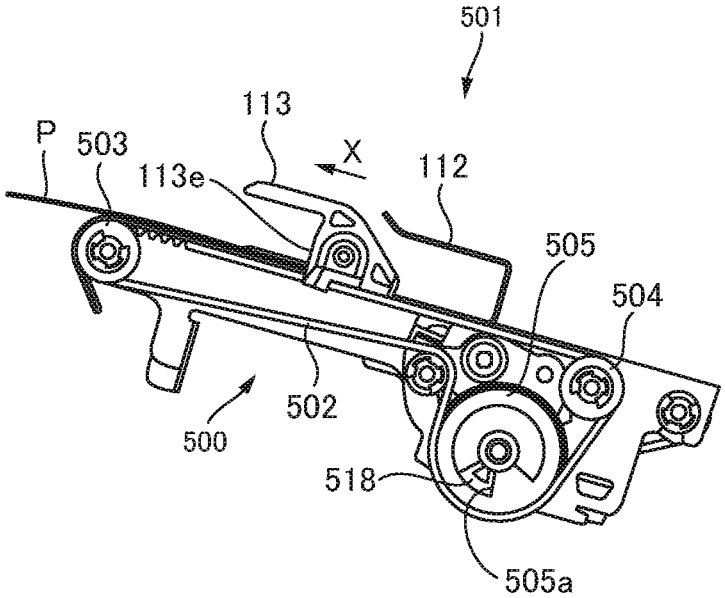
FIG. 9A illustrates an operation of the sheet conveying apparatus of the first embodiment and shows a state in which the discharge claw has passed the rear end assist.
Figure 9B:
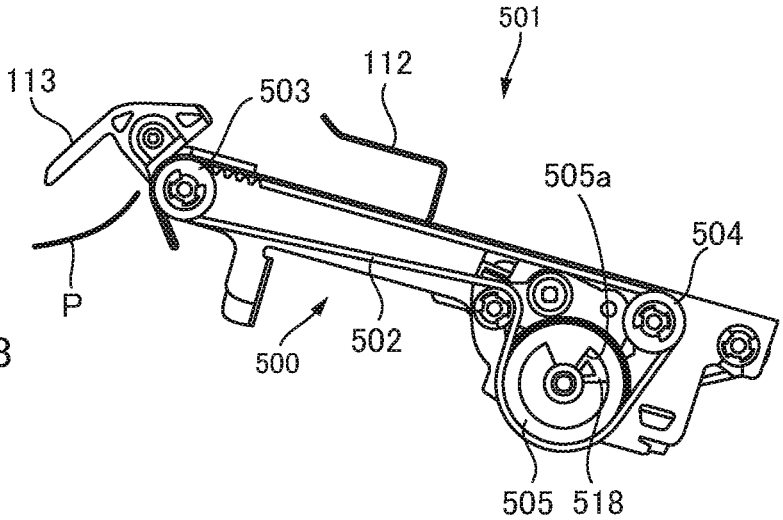
FIG. 9B illustrates an operation of the sheet conveying apparatus of the first embodiment and shows a state in which the discharge claw has pushed out a sheet.

A pulley ratio is set such that a moving speed of the discharge claw 113 is faster than a moving speed of the rear end assist 112, and the discharge claw 113 is configured to pass the rear end assist 112 in the direction of the arrow X during the move as shown in FIG. 9A. It is then possible to pass the sheet P smoothly by setting such that the discharge claw 113 passes the rear end assist 112 after when the rear end assist 112 passes the toothed pulley 504. Still further, when the discharge claw 113 pushes out the sheet P at a position shown in FIG. 9B, the discharge claw 113 and the rear end assist 112 are returned to their home positions (HP) shown in FIG. 8A by the reversely rotated assist motor M254.

Figure 10A:
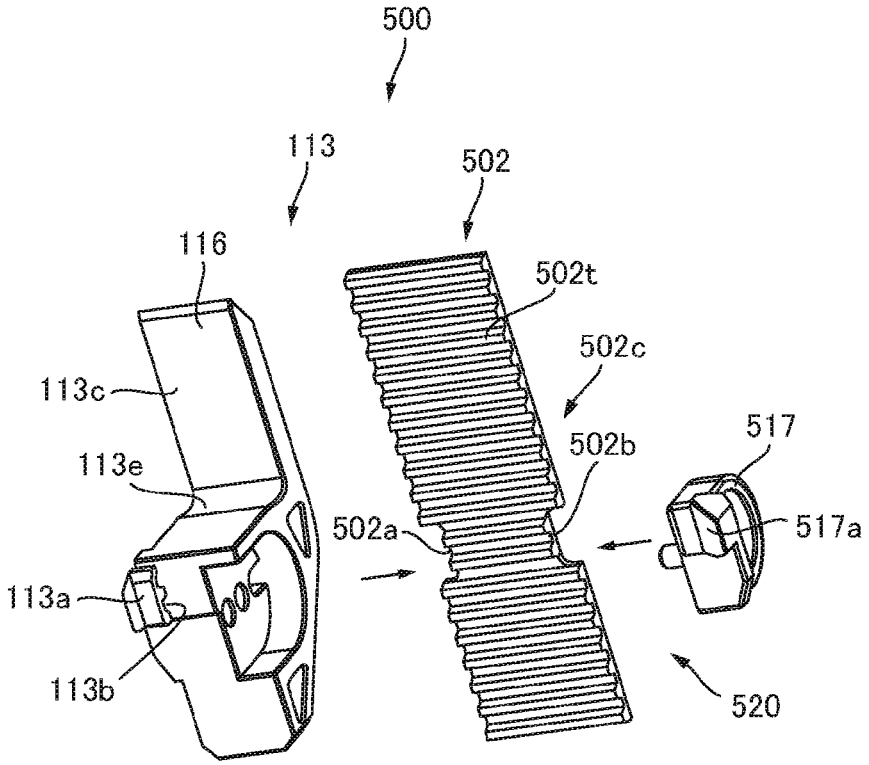
FIG. 10A is an exploded perspective view showing the discharge claw and the discharge belt of the first embodiment.
Figure 10B:
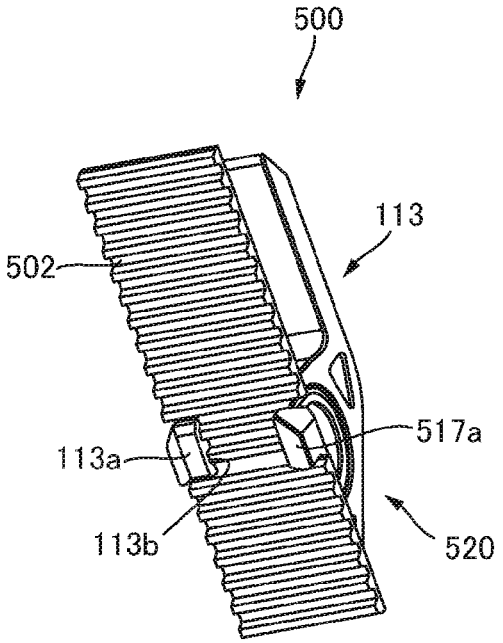
FIG. 10B is a perspective view showing the discharge claw and the discharge belt of the first embodiment.
Figure 11:
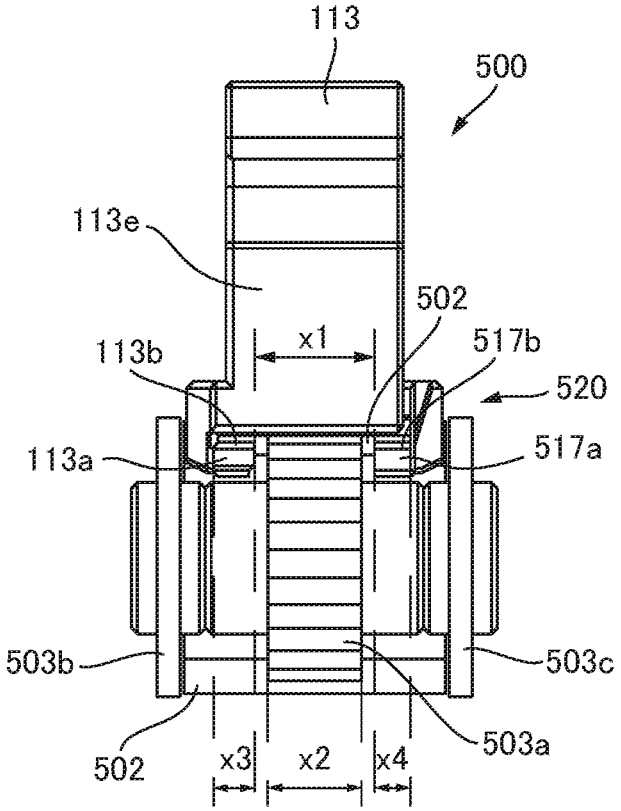
FIG. 11 is a front view of the belt of the first embodiment seen from an upstream side in a traveling direction.
Figure 12:
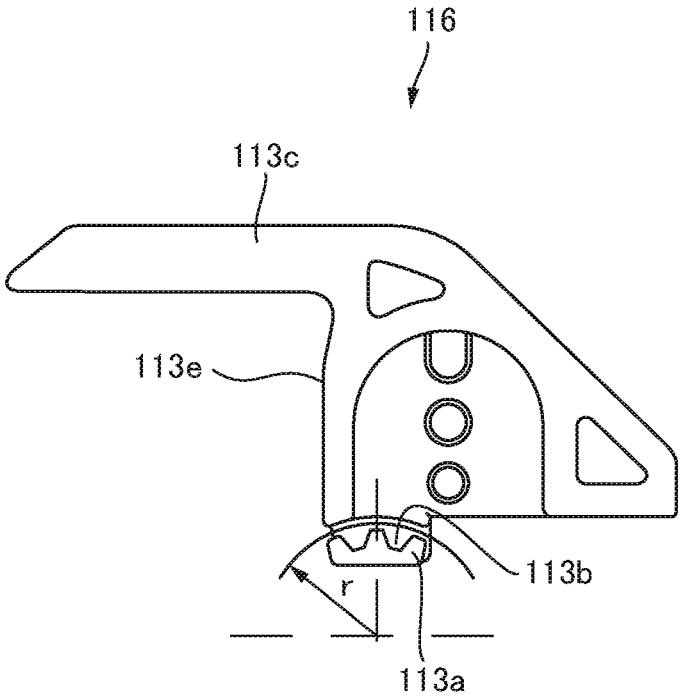
FIG. 12 is a side view of the discharge claw of the first embodiment seen from one side of a belt width direction.

Next, the connection structure of the discharge claw 113 and the discharge belt 502 will be explained with reference to FIGS. 10A through 12. FIG. 10A is an exploded perspective view of the discharge claw 113 and the discharge belt 502 and FIG. 10B is a perspective view of the belt unit 500 in which the discharge claw 113 is fixed to the discharge belt 502. FIG. 11 is a front view of the belt unit 500 of the first embodiment seen from the upstream side in the traveling direction. FIG. 12 is a side view of the discharge claw 113 of the first embodiment seen from one side of a belt width direction.

As shown in FIGS. 10A and 10B, the belt unit 500 includes the discharge belt 502 and the discharge claw 113 formed separately from the discharge belt 502. The discharge belt 502 is provided with notches 502*a* and 502*b* of a length extending in the traveling direction by two belt teeth 502*t* at both end portions in the belt width direction orthogonal to the traveling direction and the thickness direction thereof. It is noted that a cutaway portion 502*c* is formed of these notches 502*a* and 502*b*. The discharge claw 113 has a claw 113*c* projecting on a front surface side of the discharge belt 502 and capable of pushing the sheet P placed on the discharge belt 502 and a pinching portion 520 fixed by being pinched to the discharge belt 502 and attaching the claw 113*c* to the discharge belt 502. In the present embodiment, the discharge claw 113 includes a claw body 116 having the claw 113*c* and a discharge claw fixing member 517. The claw body 116 has a belt pinching portion (pinch unit) 113*a* entering the notch 502*a* and capable of pinching the two belt teeth 502*t* at a side edge portion of the notch 502*a* from the width direction. As shown in FIGS. 10A through 11, the belt pinching portion 113*a* is provided with an engage portion 113*b* engageable with the belt teeth 502*t* located on the inner side (tooth surface side) of the discharge belt 502 to reliably pinch the discharge belt 502. In the present embodiment, the engage portion 113*b* of a length of two teeth is formed to pinch the two belt teeth 502*t*.

The discharge claw fixing member 517 for fixing the claw body 116 to the discharge belt 502 is disposed on a side opposite from the claw body 116 of the discharge belt 502. The discharge claw fixing member 517 enters the notch 502*b* of the discharge belt 502 and has a belt pinching portion (pinch unit) 517*a* for pinching the two belt teeth 502*t* on a side edge portion of the notch 502*b*. The belt pinching portion 517*a* of the discharge claw fixing member 517 has an engage portion 517*b* of a length of two teeth for pinching the two belt teeth 502*t* at the side edge portion of the notch 502*b* widthwise similarly to the belt pinching portion 113*a* of the claw body 116. It is noted that the pinching portion 520 is composed of the belt pinching portions 113*a* and 517*a*.

By constructing as described above, when the discharge claw fixing member 517 is fixed to the claw body 116 by means of a screw or the like, the belt pinching portions 113*a* and 517*a* enter the notches 502*a* and 502*b* and are fixed while pinching the side edge portions of the notches 502*a* and 502*b*. Thus, the discharge claw 113 is fixed to the discharge belt 502. At this time, belt widthwise areas of the discharge belt 502 pinched by the belt pinching portions 113*a* and 517*a* are areas x3 and x4 shown in FIG. 11. The areas x3 and x4 are set so as to be able to hold such a fastening force that keeps the discharge claw 113 from deviating from the discharge belt 502 even if a high load is applied to the discharge claw 113 in conveying a sheet or in unjamming a sheet.

Here, the discharge claw 113 is configured to pass along outer circumferential surfaces of the respective pulleys (pulley curvature) of the toothed pulleys 503 and 504 and the cam pulley 505 as described above (see FIGS. 8A through 9B). Therefore, it is necessary to prevent slip out of the belt otherwise caused by the belt pinching portions 113*a* and 517*a* coming into contact with the pulley tooth portion 503*a* and riding over the pulley tooth portion 503*a* for example during when the discharge claw 113 passes through the outer circumferential surfaces of the respective toothed pulleys 503 and 504 and the cam pulley 505. Due to that, a width x2 of the pulley tooth portion 503*a* is set such that it is smaller than a distance x1 between innermost sides of the belt pinching portions 113*a* and 517*a* and such that outer sides of the belt pinching portions 113*a* and 517*a* do not deviate out of the width of the discharge belt 502. In other words, outer edges of the belt pinching portions 113*a* and 517*a* (the pinching portion 520) are set such that they are located within the side edges of the discharge belt 502. It is noted that the mode in which the outer edges of the pinching portion 520 are located inside of the side edges of the discharge belt 502 includes also a case where the outer edge of the pinching portion 520 is flush with the side edge of the discharge belt 502, i.e., a case where a maximum width of the pinching portion 520 is equal to the width of the discharge belt 502.

Pulley flanges (flange) 503*b* and 503*c* are disposed on both sides in axial directions of the toothed pulleys 503 and 504 (in the width direction of the belt unit 500) so as to sandwich the discharge belt 502 and the discharge claw 113 to restrict the discharge belt 502 and the discharge claw 113 from moving in the axial directions. At this time, a distance between the pulley flanges 503*b* and 503*c* is set to be greater than the width of the discharge belt 502. Still further, distances between the pulley tooth portion 503*a* and the pulley flanges 503*b* and 503*c* are set such that the belt pinching portions 113*a* and 517*a* does not come into contact with the pulley tooth portion 503*a* even if the discharge belt 502 leans toward either one of the pulley flanges 503*b* and 503*c*.

In the present embodiment, the sheet P is passed by the butting surface 113*e* of the discharge claw 113 abutting against the rear end of the sheet P when the discharge claw 113 passes the rear end assist 112 and the discharge claw 113 conveys the sheet P as described above. Therefore, the discharge claw 113 is required to be durable against an impact load in passing the sheet P to the discharge claw 113 and against abrasion caused on the butting surface 113*e* by an end portion of a sheet. In the present embodiment, a resin material most suitable for the abovementioned use condition is exemplified by polyacetal resin (POM) or acrylonitrile butadiene styrene resin (ABS), i.e., engineering plastics. The POM resin is characterized in that it excels in mechanical strength, abrasion resistance and slidability, and the ABS resin is characterized in that it excels in heat resistance, mechanical strength and shock resistance and has good moldability, so that the both materials can be said to be suitable materials.

Still further, the belt pinching portions 113*a* and 517*a* are configured to pinch the two belt teeth 502*t* to increase the fastening force when the discharge claw 113 is fixed to the discharge belt 502 as described above. The discharge claw 113 is also configured to pass along the outer circumferential surfaces (pulley curvature) of the respective pulleys of the toothed pulleys 503 and 504 and the cam pulley 505. Then, as shown in FIG. 12, the engage portion 113*b* of the belt pinching portion 113*a* is formed into a shape having a curvature following a radius r of a pitch circle of the smallest pulley (smallest pitch circle) among the toothed pulleys 503 and 504 and the cam pulley 505. It is noted that the engage portion 517*b* of the belt pinching portion 517*a* is also formed to have the similar curvature with the engage portion 113*b*, though it is not shown.

It is noted that although the length of the engage portions 113*b* and 517*b* is that of the two belt teeth in the present embodiment, the length is not limited to that of the two teeth in a case where a pulley having a large diameter is used and the engage portion may be configured to be able to pinch three or more teeth. Still further, the curvature of the engage portions 113*b* and 517*b* is not limited to the radius of the smallest pitch circle and may be a radius of a large pitch circle as long as that will not cause rise-up of the discharge claw 113 and slip-out of the belt when the discharge claw 113 passes on the pulley. That is, the radius r of the pitch circle of the engage portions 113*b* and 517*b* is desirable to set within a range of the following equation with respect to a radius r1 of a pitch circle of the smallest pulley (smallest pitch circle) and to a radius r2 of a pitch circle of the largest pulley (largest pitch circle) among the pulleys on which the discharge claw 113 passes. That is, it is desirable to set the radius r of the pitch circle within a range of: $r1 \leq r \leq r2$ (larger than a radius of the smallest pitch circle and smaller than a radius the largest pitch circle).

In the present embodiment, an elastically deformable rubber material is used as a material of the discharge belt 502 because smaller pulleys are used to downsize the finisher 100. Therefore, it is possible to prevent the discharge belt 502 from rising up from the pulley by the elasticity of the discharge belt 502 itself even if the curvature is that of the small pulley. It is noted that a more rigid urethane material may be used as the material of the discharge belt 502 if no smaller pulley is used. It is advantageous to use the belt made of the urethane material in such points that it is possible to suppress deflection and torsion of the belt itself caused by a load of a sheet being conveyed and to convey a sheet more stably.

Figure 13:
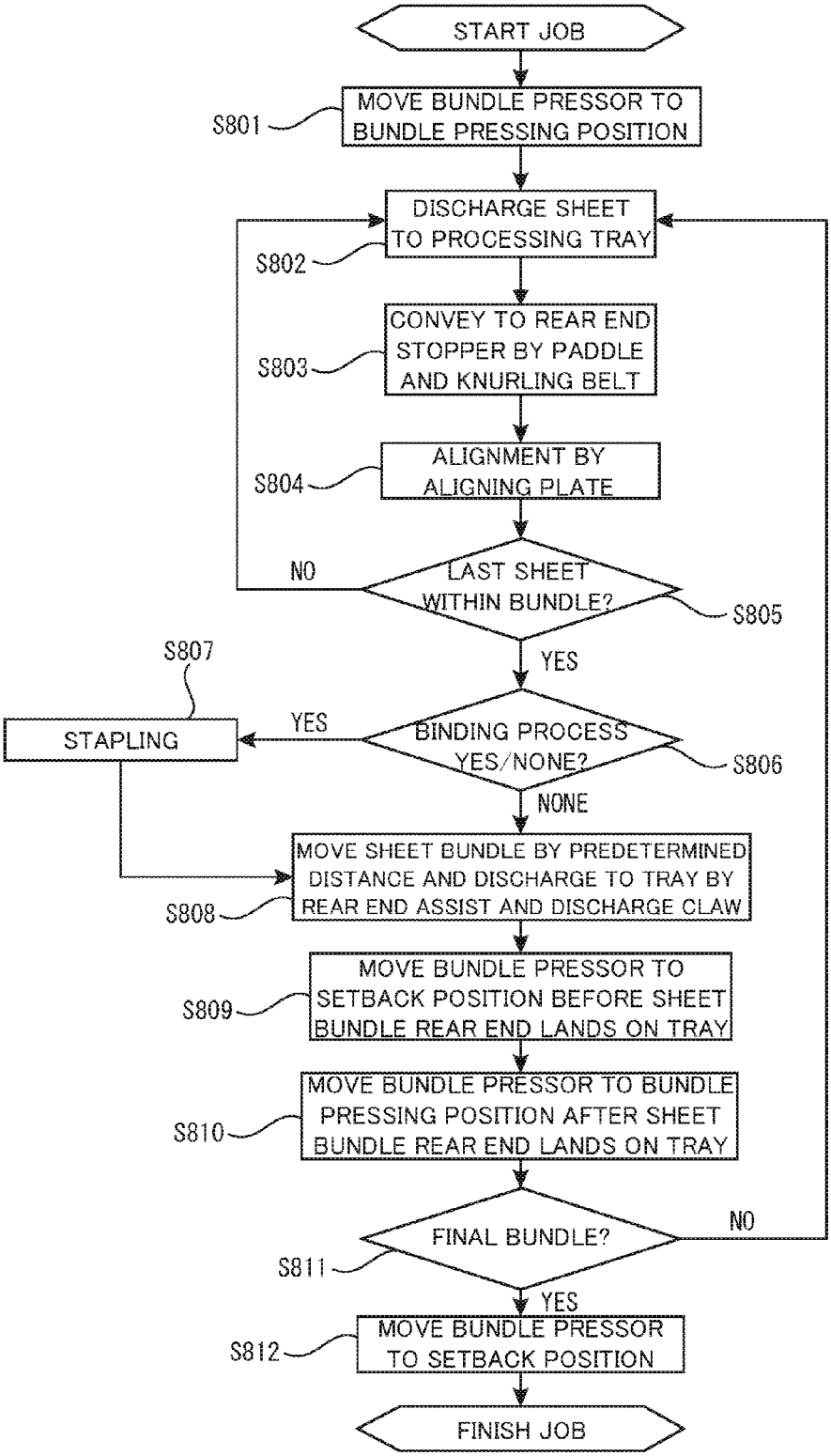
FIG. 13 is a flowchart of a binding job of the first embodiment.

Next, a binding job performed on the sheet bundle PA by the stapler 110 (control made by the finisher control portion 220) will be explained with reference to FIG. 13. FIG. 13 is a flowchart of the binding job of the first embodiment.

As shown in FIG. 13, when the job is started, the finisher control portion 220 turns the bundle pressor 115 such the bundle pressor 115 is positioned at the bundle pressing position at first in Step S801 (see FIG. 4A). In this state, the sheet P is discharged on the processing tray 107 by the discharge roller 103 in Step S802. The rear end portion of sheet P discharged on the processing tray 107 is then returned to the rear end stopper 108 by the force in a direction opposite from the conveying direction applied by the paddle 106 and the knurling belt 117 in Step S803 (see FIG. 4B). After that, the position of the sheet P in the width direction orthogonal to the conveying direction is corrected by the pair of aligning plates 109 in Step S804 (see FIG. 4B).

When the discharge and aligning operations of a required number of sheets P have been carried out in Step S805 (see FIG. 5A), the finisher control portion 220 judges whether or not a binding process (stapling) needs to be carried out in Step S806. If the binding process is necessary, the binding process is carried out by the stapler 110 on the aligned sheet bundle PA in Step S807. When the binding process ends, the sheet bundle PA is discharged out of the apparatus from the processing tray 107 by the sheet conveying apparatus 501 and is stacked on the stacking tray 114 in Step S808.

Specifically, when the sheet conveying apparatus 501 is driven, the rear end assist 112 moves in the sheet conveying direction and pushes the rear end portion of the sheet P (see FIGS. 8A and 8B). At this time, the cam pulley 505 does not rotate and the discharge belt 502 is also kept stopping. When the cam 518 of the assist camshaft 512 abuts against the rib surface 505*a* of the cam pulley 505, the cam pulley 505 starts to rotate and the discharge belt 502 starts to travel (see FIG. 8C). When the discharge belt 502 travels, the discharge claw 113 starts to move and conveys the sheet P by receiving the sheet P by abutting the butting surface 113*e* against the rear end portion of the sheet P in passing the rear end assist 112 (see FIGS. 9A and 5B). When the discharge claw 113 moves by a predetermined distance, the sheet bundle PA is discharged to the stacking tray 114 (see FIG. 9B).

At this time, the bundle pressor 115 is moved to the setback position before the rear end portion of the sheet bundle PA lands on the stacking tray 114, and when the sheet bundle PA lands, the bundle pressor 115 is moved again to the bundle pressing position to be ready for a next sheet bundle in Steps S809 and S810 (see FIG. 5C). The above-mentioned operations are repeated until a final bundle in Step S811. After when the final bundle is discharged, the bundle pressor 115 is moved to the setback position so that the user can easily take the sheet bundles PA on the stacking tray 114. Thus, the job ends in Step S812.

As described above, the printer 900 can stabilize the posture of the discharge claw 113 with respect to the discharge belt 502 after fastening by fixing the discharge claw 113 to the discharge belt 502 by pinching the side edge portions of the notches 502*a* and 502*b* by the belt pinching portions 113*a* and 517*a*. This arrangement makes it possible to stabilize the posture of the discharge claw 113 in conveying a sheet and to prevent conveyance failure and the like.

Still further, according to the sheet conveying apparatus 501 of the present embodiment, the belt pinching portions 113*a* and 517*a* are located inside of the width of the discharge belt 502, so that it is possible to restrict the position of the discharge belt 502 in a thrust direction, i.e., in a pulley axis direction, by the flanges of the pulleys in the same manner with the conventional method. Thus, it is possible to avoid the apparatus from being complicated.

Still further, because the discharge claw 113 is prepared separately beforehand and is fastened to the belt without inject-molding the discharge claw by a resin material by setting the conventional discharge belt having support projections into a molding die, so that a range of options in terms of the shape and the material of the discharge claw 113 is widened. For instance, it is possible to form the discharge claw 113 into a complex shape in injection-molding the discharge claw 113 by a resin material and to select a metallic material in a case where strength of the discharge claw 113 is preferable to be strong.

Second Embodiment

Figure 14A:
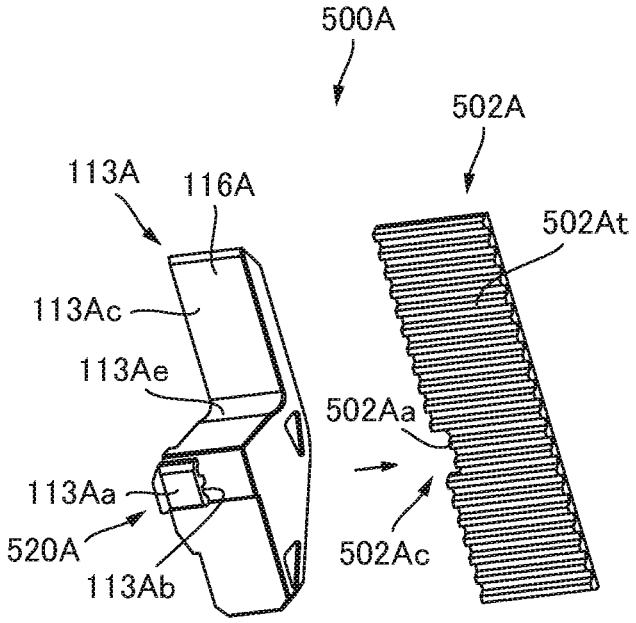
FIG. 14A is an exploded perspective view showing a discharge claw and a discharge belt of a second embodiment.
Figure 14B:
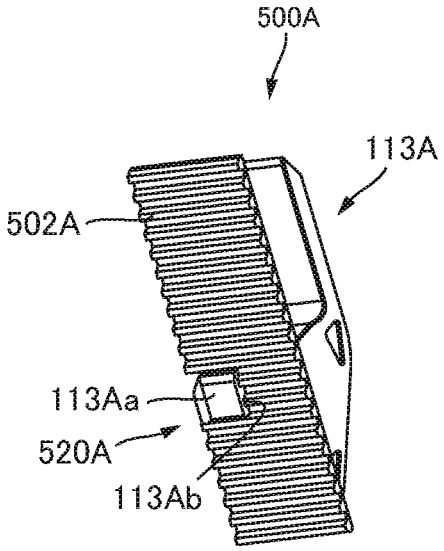
FIG. 14B is a perspective view showing the discharge claw and the discharge belt of the second embodiment.
Figure 15:
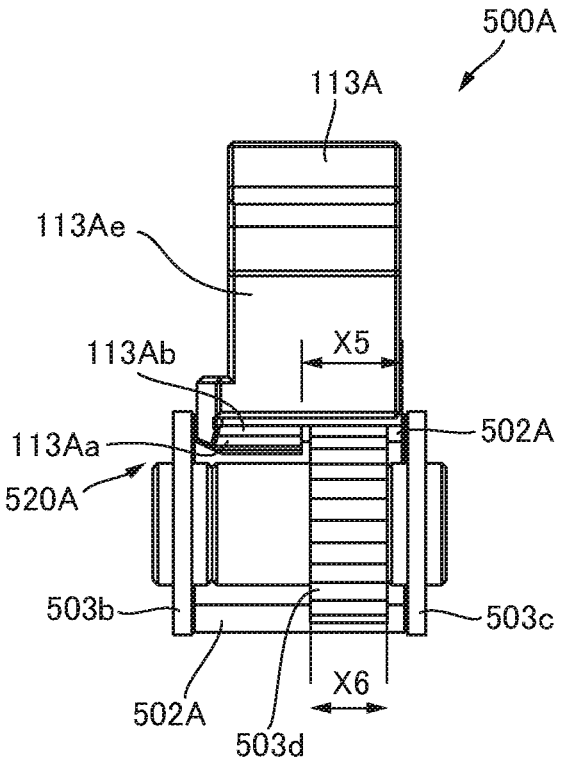
FIG. 15 is a front view of the belt of the second embodiment seen from the upstream side in the traveling direction.

Next, a second embodiment of the present invention will be explained with reference to FIGS. 14A through 15. FIG. 14A is an exploded perspective view of a discharge claw 113A and a discharge belt 502A of the second embodiment and FIG. 14B is a perspective view of a belt unit 500A in which the discharge claw 113A is fixed to the discharge belt 502A. FIG. 15 is a front view of the belt unit 500A of the second embodiment seen from the upstream side in the traveling direction.

In the second embodiment, a pinching position where the discharge claw 113A pinches the discharge belt 502A is different from that of the first embodiment. While the discharge claw 113 is fixed to the discharge belt 502 by pinching the both widthwise sides of the discharge belt 502 by the pinching portion 520 in the first embodiment, the discharge claw 113A is fixed to the discharge belt 502A by pinching one side of the discharge belt 502A by a pinching portion 520A in the second embodiment. Therefore, an explanation will be made here centering on the discharge claw 113A and the discharge belt 502A and the other components will be denoted by the same reference numerals with those of the first embodiment and an explanation thereof will be omitted here.

As shown in FIGS. 14A and 14B, the discharge belt 502A is provided with a notch 502Aa of a length of two teeth in the traveling direction at one widthwise side (one end portion) thereof. This notch 502Aa composes a cutaway portion 502Ac. The discharge claw 113A includes a claw 113Ac projecting on the front surface side of the discharge belt 502A and capable of pushing the sheet P placed on the discharge belt 502A and the pinching portion 520A fixed to the discharge belt 502A by way of pinching and attaching the claw 113Ac to the discharge belt 502A. The discharge claw 113A has a belt pinching portion 113Aa entering the notch 502Aa and pinching two belt teeth 502At at the side edge portion of the notch 502Aa. This belt pinching portion 113Aa composes the pinching portion 520A. The belt pinching portion 113Aa is provided with an engage portion 113Ab engaging with the belt teeth 502At of the discharge belt 502A to firmly pinch the discharge belt 502A. Preferably, the engage portion 113Ab is set such that it is slightly press-fitted into the belt teeth 502At of the discharge belt 502A. It is possible to fix the discharge claw 113A to the discharge belt 502A by setting the engage portion 113Ab such that it is slightly press-fitted into the belt teeth 502At and by inserting the belt pinching portion 113Aa into the notch 502Aa and by pinching the two belt teeth 502At at the side edge portion of the notch 502Aa. That is, the belt pinching portion 113Aa is configured to enter the notch 502Aa and to fix a widthwise position of the discharge claw 113A by a pinching pressure pinching the discharge belt 502A from its thickness direction.

Here, the discharge claw 113A is configured to pass along the outer circumferential surfaces (pulley curvature) of the respective pulleys of the toothed pulleys 503 and 504 and the cam pulley 505. Therefore, it is necessary to prevent slip-out of the belt otherwise caused when the belt pinching portion 113Aa comes into contact with the pulley tooth portion 503*d* and rides up during when the discharge claw 113A passes through the toothed pulleys 503 and 504 and the cam pulley 505 as shown in FIG. 15. Due to that, a width x6 of the pulley tooth portion 503*d* is set to be smaller than a distance x5 between a belt inner end portion of the belt pinching portion 113Aa and the belt edge portion and the size of the belt pinching portion 113A is set such that an outer side thereof will not deviate out of the width of the discharge belt 502A.

Pulley flanges 503*b* and 503*c* are disposed so as to sandwich the discharge belt 502A and the discharge claw 113A on both sides in the axial direction of the toothed pulleys 503 and 504 (in the width direction of the belt unit 500A) to restrict the axial move of the discharge belt 502A and the discharge claw 113A. At this time, a distance between the pulley flanges 503*b* and 503*c* is set to be larger than the width of the discharge belt 502A. A distance between the pulley tooth portion 503*d* and the pulley flange 503*c* is set such that the inner end portion of the belt pinching portion 113Aa does not come into contact with the pulley tooth portion 503*d* even if the discharge belt 502A leans toward the pulley flange 503*c*.

Similarly to the first embodiment, this arrangement makes it possible to stabilize the posture when the discharge claw 113A is fastened to the discharge belt 502A and allows the discharge claw 113A to smoothly pass on the toothed pulleys 503 and 504 and the cam pulley 505.

Third Embodiment

Figure 16A:
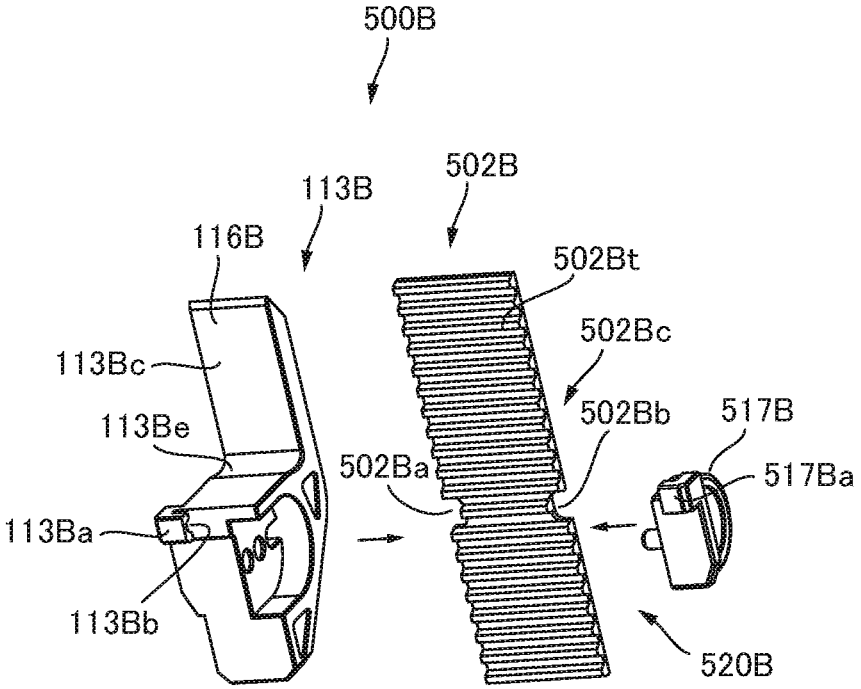
FIG. 16A is an exploded perspective view showing a discharge claw and a discharge belt of a third embodiment.
Figure 16B:
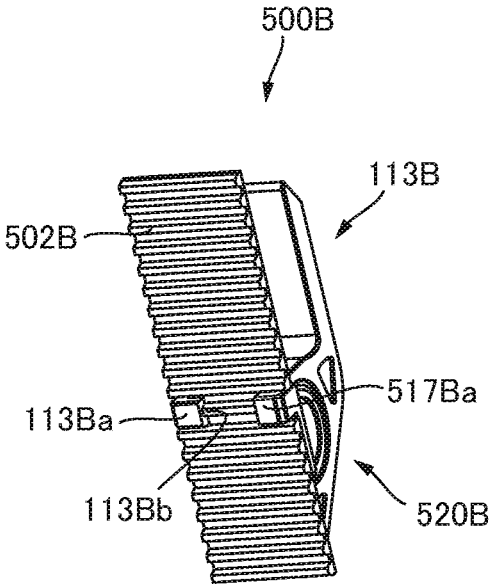
FIG. 16B is a perspective view showing the discharge claw and the discharge belt of the third embodiment.
Figure 17:
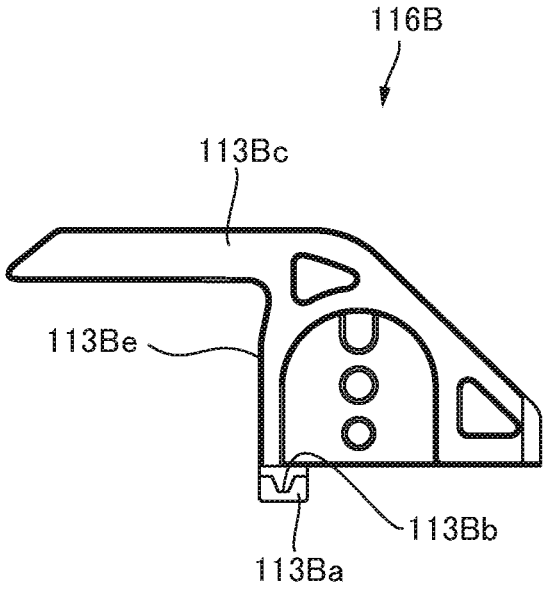
FIG. 17 is a side view of the discharge claw of the third embodiment seen from one side in a belt width direction.

Next, a third embodiment of the present invention will be explained with reference to FIGS. 16A through 17. FIG. 16A is an exploded perspective view of a discharge claw 113B and a discharge belt 502B of the third embodiment and FIG. 16B is a perspective view of a belt unit 500B in which the discharge claw 113B is fixed to the discharge belt 502B. FIG. 17 is a side view of the discharge claw 113B of the third embodiment seen from one belt widthwise direction.

The third embodiment is different from the first embodiment in that a number of belt teeth 502Bt of the discharge belt 502B pinched by a pinching portion 520B of the discharge claw 113B is different. Therefore, an explanation will be made here centering on the discharge claw 113B and the discharge belt 502B and the other components will be denoted by the same reference numerals with those of the first embodiment and an explanation thereof will be omitted here.

As shown in FIGS. 16A and 16B, the discharge belt 502B is provided with notches 502Ba and 502Bb of a length of one tooth in the traveling direction at both widthwise sides (both end portions) thereof. The notches 502Ba and 502Bb compose a cutaway portion 502Bc. The discharge claw 113B includes a claw 113Bc projecting on the front surface side of the discharge belt 502B and capable of pushing the sheet P placed on the discharge belt 502B and a pinching portion 520B fixed to the discharge belt 502B by way of pinching and attaching the claw 113Bc to the discharge belt 502B. In the present embodiment, the discharge claw 113B has a claw body 116B having the claw 113Bc and a discharge claw fixing member 517B. The claw body 116B has a belt pinching portion 113Ba entering the notch 502Ba and pinching one belt tooth 502Bt at the side edge portion of the notches 502Ba. As shown in FIG. 17, the belt pinching portion 113Ba is provided with an engage portion 113Bb engaging with the belt teeth 502Bt of the discharge belt 502B to firmly pinch the discharge belt 502B. In the present embodiment, the engage portion 113Bb of the length of one tooth is formed to pinch the one belt tooth 502Bt as described above.

The discharge claw fixing member 517B for fixing the claw body 116B to the discharge belt 502B is disposed on a side opposite from the claw body 116B of the discharge belt 502B. The discharge claw fixing member 517B has the belt pinching portion 517Ba configured to enter the notch 502Bb of the discharge belt 502B and to pinch one belt tooth 502Bt of the side edge portion of the notch 502Bb. The belt pinching portion 517Ba of the discharge claw fixing member 517B includes the engage portion 517Bb of the length of one tooth for pinching one tooth of the belt teeth 502Bb at the side edge portion of the notch 502Bb widthwise similarly to the belt pinching portion 113Ba of the claw body 116B. It is noted that the pinching portion 520B is composed of the belt pinching portions 113Ba and 517Ba.

Thus, in a case where the materials of the claw body 116B and the discharge claw fixing member 517B are strong like metal, the claw body 116B may be configured to pinch one tooth of the belt teeth 502Bt. When the discharge claw fixing member 517B is fixed to the claw body 116B by a screw or the like, the belt pinching portions 113Ba and 517Ba enter the notches 502Ba and 502Bb of the discharge belt 502B and are fixed firmly while pinching the side edge portions of the notches 502Ba and 502Bb. Accordingly, it is possible to stabilize the posture of the discharge claw 113B when the discharge claw 113B is fixed to the discharge belt 502B and to obtain the similar effects with those of the first embodiment.

Fourth Embodiment

Figure 18A:
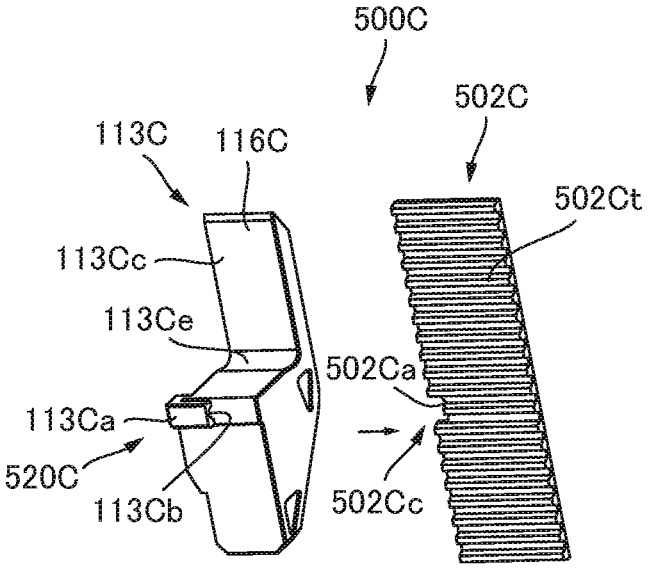
FIG. 18A is an exploded perspective view showing a discharge claw and a discharge belt of a fourth embodiment.

Next, a fourth embodiment of the present invention will be explained with reference to FIGS. 18A and 18B. FIG. 18A is an exploded perspective view of a discharge claw 113C and a discharge belt 502C of the fourth embodiment and FIG. 18B is a perspective view of a belt unit 500C in which the discharge claw 113C is fixed to the discharge belt 502C.

The fourth embodiment is different from the third embodiment in that a pinching position where the discharge claw 113C pinches the discharge belt 502C is different. While the discharge claw 113B is fixed to the discharge belt 502B by pinching the both widthwise sides of the discharge belt 502B by the pinching portion 520B in the third embodiment, the discharge claw 113C is fixed to the discharge belt 502C by pinching one side of the discharge belt 502C by a pinching portion 520C in the fourth embodiment. Therefore, an explanation will be made here centering on the discharge claw 113C and the discharge belt 502C and the other components will be denoted by the same reference numerals with those of the first and third embodiments and an explanation thereof will be omitted here.

Figure 18B:
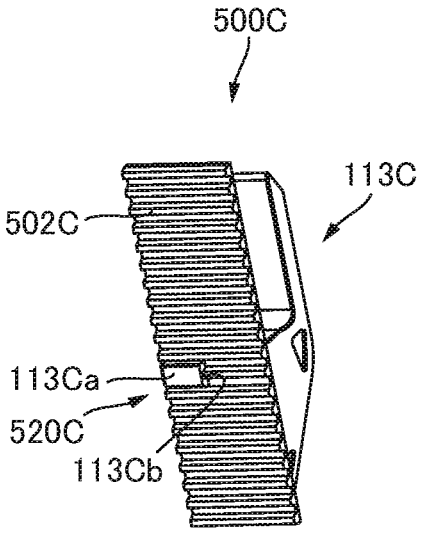
FIG. 18B is a perspective view showing the discharge claw and the discharge belt of the fourth embodiment.

As shown in FIGS. 18A and 18B, the discharge belt 502C is provided with a notch 502Ca of a length of one tooth in the traveling direction at one widthwise side (one end portion) thereof. This notch 502Ca composes a cutaway portion 502Cc. The discharge claw 113C includes a claw 113Cc projecting on the front surface side of the discharge belt 502C and capable of pushing the sheet P placed on the discharge belt 502C and a pinching portion 520C fixed to the discharge belt 502C by way of pinching and attaching a claw 113Cc to the discharge belt 502C. The discharge claw 113C has a belt pinching portion 113Ca entering the notch 502Ca and pinching one belt tooth 502Ct at the side edge portion of the notch 502Ca. This belt pinching portion 113Ca composes the pinching portion 520C. The belt pinching portion 113Ca is provided with an engage portion 113Ca engaging with the belt teeth 502Ct of the discharge belt 502C to firmly pinch the discharge belt 502C. Preferably, the engage portion 113Cb is set such that it is slightly press-fitted into the belt teeth 502Ct of the discharge belt 502C.

In the case where the materials of the claw body 116C and the discharge claw fixing member 517C are strong such as metal, the claw body 116C may be configured to pinch one belt tooth 502Ct as described above. It is possible to fix the discharge claw 113C to the discharge belt 502C by setting such that the engage portion 113Cb is slightly press-fitted into the belt teeth 502Ct and by inserting the belt pinching portion 113Ca into the notch 502Ca and by pinching the one belt tooth 502Ct at the side edge portion of the notch 502Ca. Accordingly, it is possible to stabilize the posture of the discharge claw 113C when the discharge claw 113C is fastened to the discharge belt 502C and to obtain the similar effects with those of the third embodiment.

While the embodiments of the invention have been described above, the present invention is not limited to the respective embodiments described above. Still further, the advantageous effects described in the embodiments of the invention are merely an enumeration of the most preferable effects brought about from the present invention, so that the advantageous effects of the invention are not limited to those described in the embodiments of the invention.

For instance, while the respective embodiments described above have been explained by exemplifying the finisher 100 having the sheet conveying apparatus 501, the present invention is not limited to that. The sheet conveying apparatus 501 may be used in the printer 900. While the post-processing portion of the finisher 100 has been also explained by using the stapler 110, the post-processing portion is not limited to that. For instance, the post-processing portion may be a staple-less binding unit, a book-binding unit or the like.

Still further, while the respective embodiments described above have been described by using the sheet conveying apparatus 501 having the rear end assist 112 for pushing the sheet bundle PA, the present invention is not limited to that. The sheet conveying apparatus 501 does not always require the rear end assist 112.

While the respective embodiments described above have been described by using the toothed discharge belt 502, the present invention is not also limited to that. It is also possible to use a discharge belt having no belt teeth if the discharge claw can be fixed to the discharge belt by the belt pinching portion.

Still further, while the CPU 221 of the finisher control portion 220 mounted in the finisher 100 controls the finisher 100 in the respective embodiments described above, it is also possible to configure such that the finisher 100 is controlled directly by the CPU circuit portion 200 provided in the printer 900. Still further, the CPU may be a CPU in an information device such as a separate personal computer and the CPU for controlling the finisher 100 is not always provided in the finisher 100 itself. In the case where the CPU is provided in the separate information device or the like, the various controls are made by transmitting/receiving signals through communication circuits or the like (regardless whether it is wired or wireless). Such mode is applicable not only to the CPU described above but also to the RAM, ROM and others.

Still further, while the respective embodiments described above have been explained by exemplifying the electrophotographic printer, the present invention is not limited to that. For instance, the present invention is applicable also to an ink-jet type printer (image forming apparatus) configured to form an image on a sheet by discharging ink droplets from a nozzle.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A sheet conveying apparatus comprising:

a belt comprising a first surface having a width in a width direction orthogonal to a traveling direction of the belt, a second surface opposite from the first surface, and widthwise side surfaces formed in widthwise side ends of the belt and connecting the first and second surfaces, at least one of the widthwise side surfaces including a portion defining a notch being recessed in the width direction, the notch being defined by less than an entire length, in the traveling direction, of the widthwise side surface;

a contacting member arranged to be in contact with an end portion of a sheet to be conveyed, the contacting member is attached to the belt so that at least a part of the contacting member is arranged in the notch of the belt;

a regulating portion configured to regulate a position of the belt in the width direction by contacting with the widthwise side surface of the belt; and a driving portion configured to drive the belt to move the contacting member.

2. The sheet conveying apparatus according to claim 1, wherein the belt is driven and rotated by the driving portion so that the contacting member passes by the regulating portion in the traveling direction.

3. The sheet conveying apparatus according to claim 1, wherein the contacting member comprises a first portion provided on a side of the first surface, a second portion provided on a side of the second surface, and a third portion configured to connect the first and second portions through the notch.

4. The sheet conveying apparatus according to claim 3, wherein the first portion of the contacting member comprises a contacting portion configured to contact with the end portion of the sheet, and the second portion configured to engage with a concavo-convex portion formed on the second surface of the belt.

5. The sheet conveying apparatus according to claim 1, wherein the regulating portion is configured to contact with a portion of the widthwise side surface other than the portion defining the notch.

6. The sheet conveying apparatus according to claim 1, wherein the contacting member is located inside of side portions of the belt in the width direction.

7. The sheet conveying apparatus according to claim 1, further comprising a rotating member configured to support the belt, wherein the regulating portion is provided on the rotating member.

8. The sheet conveying apparatus according to claim 7, wherein the regulating portion comprises a flange portion formed with the rotating member.

9. An image forming apparatus comprising:

an image forming portion configured to form an image on a sheet; and a conveying apparatus according to claim 1 configured to convey a sheet on which the image has been formed in the image forming portion.

10. A sheet conveying apparatus comprising:

a belt comprising a first surface having a width in a width direction orthogonal to a traveling direction of the belt, a second surface opposite from the first surface, a first widthwise side surface formed in one of widthwise side ends of the belt and connecting the first and second surfaces, and a second widthwise side surface formed in the other of widthwise side ends of the belt and connecting the first and second surfaces, the first widthwise side surface including a portion defining a first notch being recessed in the width direction orthogonal to the traveling direction, the second widthwise side surface including a portion defining a second notch being recessed in the width direction, the first notch being defined by less than an entire length, in the traveling direction, of the first widthwise side surface, the second notch being defined by less than an entire length, in the traveling direction, of the second widthwise side surface;

a contacting member arranged to be in contact with an end portion of a sheet to be conveyed, the contacting member being attached to the belt so that a first part of the contacting member is arranged in the first notch of the belt and a second part of the contacting member is arranged in the second notch of the belt;

a first regulating portion configured to regulate a position of the belt in the width direction by contacting with the first widthwise side surface of the belt;

a second regulating portion configured to regulate a position of the belt in the width direction by contacting with the second widthwise side surface of the belt; and a driving portion configured to drive the belt to move the contacting member.

11. The sheet conveying apparatus according to claim 10, wherein the belt is driven and rotated by the driving portion so that the contacting member passes by the first and second regulating portions in the traveling direction.

12. The sheet conveying apparatus according to claim 10, wherein the contacting member comprises a third part provided on a side of the first surface, and a fourth part provided on a side of the second surface, the first part of the contacting member is configured to connect the third and fourth parts through the first notch, and the second part of the contacting member is configured to connect the third and fourth parts through the second notch.

13. The sheet conveying apparatus according to claim 12, wherein the third part of the contacting member comprises a contacting portion configured to contact with the end portion of the sheet, and the fourth part of the contacting member configured to engage with a concavo-convex portion formed on the second surface of the belt.

14. The sheet conveying apparatus according to claim 10, wherein the first regulating portion is configured to contact with a portion of the first widthwise side surface other than the portion defining the first notch, and the second regulating portion is configured to contact with a portion of the second widthwise side surface other than the portion defining the second notch.

15. The sheet conveying apparatus according to claim 10, wherein the contacting member is located inside of side portions of the belt in the width direction.

16. The sheet conveying apparatus according to claim 10, further comprising a rotating member configured to support the belt, wherein the first and second regulating portions are provided on the rotating member.

17. The sheet conveying apparatus according to claim 16, wherein the first regulating portion comprises a first flange portion formed with the rotating member, and the second regulating portion comprises a second flange portion formed with the rotating member.

18. The sheet conveying apparatus according to claim 1, further comprising a binding unit configured to bind sheets, wherein the belt is driven and rotated by the driving portion so that the contacting member conveys a sheet bundle bond by the binding unit.

19. The sheet conveying apparatus according to claim 10, further comprising a binding unit configured to bind sheets, wherein the belt is driven and rotated by the driving portion so that the contacting member conveys a sheet bundle bond by the binding unit.

* * * * *